US005297118A

United States Patent [19]

Sakumoto

[11] Patent Number: 5,297,118

[45] Date of Patent: Mar. 22, 1994

[54] ELECTRONIC WATCH WITH PAGER

[75] Inventor: Kazumi Sakumoto, Tokyo, Japan

[73] Assignee: Seiko Instruments Inc., Japan

[21] Appl. No.: 81,550

[22] Filed: Jun. 23, 1993

[30] Foreign Application Priority Data

Jul. 2, 1992 [JP] Japan ..... 4-175312

[51] Int. Cl.[5] ..... G04B 47/00; G04B 19/04

[52] U.S. Cl. ..... 368/10; 368/80; 340/825.44

[58] Field of Search ..... 368/10, 11, 80; 340/825.44, 825.49

[56] References Cited

U.S. PATENT DOCUMENTS

| | | | |
|---|---|---|---|
| 4,663,624 | 5/1987 | Bui et al. | 368/255 |
| 4,786,902 | 11/1988 | Davis et al. | 368/11 |
| 4,845,485 | 7/1989 | Pace | 368/10 |
| 4,872,005 | 10/1989 | DeLuca et al. | 304/825.44 |
| 4,985,878 | 1/1991 | Yamada et al. | 368/88 |
| 5,140,561 | 8/1992 | Miyashija | 368/10 |

*Primary Examiner*—Vit W. Miska

*Attorney, Agent, or Firm*—Bruce L. Adams; Van C. Wilks

[57] ABSTRACT

An electronic watch provided with a pager excellent from design and fashion standpoints and capable of displaying a call signal, a caller identifying signal, a message such as a telephone number, etc. can be provided.

On the basis of an output signal of the external inputting element 11, received and stored information signals are selected Further, the time signal outputted by the time measuring circuit 15 and the received information signal outputted by the received information storing circuit 9 are selected by the analog display switching circuit 16 and the digital display switching circuit 17, respectively. The selected outputted signals are inputted to the analog display unit 26 and a digital display unit 20 to display the time information and the pager information, selectively.

4 Claims, 9 Drawing Sheets

ELECTRONIC WATCH WITH PAGER

BACKGROUND OF THE INVENTION

The present invention relates to an electronic watch provided with a pager for receiving a call signal and for informing the user of the received call.

The conventional pager will be described hereinbelow with reference to FIG. 5. When a call number of a person required to call is inputted to a telephone, the call signal thereof is given to a radio paging station through a telephone network and then transmitted therefrom. A high frequency receiving element 1 of the pager receives the call signal and then outputs the received call to a signal demodulating circuit 2. The received call signal is demodulated by the signal demodulating circuit 2 into a digital signal, and then stored in a received information storing circuit 9. A call number comparing circuit 4 compares the received call signal now stored in the received information storing circuit 9 with a plurality of call numbers previously stored in a call number storing circuit 3. When the comparison results match each other, an alarming element 5 generates an alarm such as sound, light, vibration, etc. to inform the user of the incoming call.

Recently, there has been widely used such a pager that when a caller inputs his identification number or his message (e.g., a telephone number) after call signal, the caller identification number and the message can be displayed on an LCD (liquid crystal display) panel section, in addition to the generation of an alarm for indicating call reception. Further, a pager small in size and light in weight has been required more and more by the users.

Therefore, a watch type pager excellent in portability has been proposed. However, the watch type pager so far proposed is a digital display type pager of a large LCD panel, because the amount of information is large.

On the other hand, however, the analog display watches (including watches provided with both analog and digital display functions, and thereby referred to as combination watches, hereinafter) are greater than the digital display watches (including only digital display function) in the amount of both sale and production. This is because the analog display watches are suitable for users' demand from the design and fashion standpoints.

Consequently, an analog display watch provided with pager function has been proposed. In the conventional analog display watch provided with pager function, however, the function is only to receive a call signal and inform the user of the call reception, thus involving a problem in that it is impossible to acquire other information.

Further, even in the case of the combination watch provided with both analog and digital display functions, there exists another problem in that it is impossible to use a large digital display panel from the design and fashion standpoints, so that the sufficient pager information cannot be displayed on a small digital display panel.

SUMMARY OF THE INVENTION

The object of the present invention is to provide an electronic watch provided with a pager which can display various information such as a caller identification number, a caller message such as a telephone number, etc. in addition to a call alarm, in the form of the combination watch which is excellent from the design and fashion standpoints.

To solve the above-mentioned problems, in the first aspect of the present invention, the received and stored information signals are selected in response to an output signal of the external inputting means. The time signal outputted by the time measuring means and received information signals outputted by the received information storing means are selected by the display switching means. The outputs of the display switching means are inputted to the analog display means and the digital display means, respectively. In summary, the time or the caller identification number are selectively displayed on the analog display means. The time and the caller message are selectively displayed on the digital display means.

In the second aspect of the present invention, the time signal outputted by the time measuring means is inputted to the analog display means. The received information signals are selected in response to the output signal of the external inputting means. The time signal outputted by the time measuring means and the received information signal outputted by the message storing means are selected by the digital display switching means. The output signal of the digital display switching means is inputted to the digital display means. The output signal of the caller identifying signal storing means of the received information storing means is inputted to the pager information analog display means. In summary, the time is displayed on the analog display means. The caller identification number is displayed on the pager analog display means. The time and the caller message are selectively displayed on the digital display means.

In the third aspect of the present invention, the reception time is stored in the reception time storing means in response to a match signal of the call number comparing means. The received information signals stored are selected in response to an output signal of an external inputting means.

The time signal outputted by the time measuring means, the received information signal outputted by the caller identifying signal storing means, and the reception time signal outputted by the reception time storing means are selected by the analog display switching means. The signal outputted by the analog display switching means is inputted to the analog display means. The time signal outputted by the time measuring means and the received signal outputted by the message storing means are selected by the digital display switching means. The signal outputted by the digital display switching means is inputted to the digital display means. In summary, the time, the caller identification number and the reception time are displayed on the analog display means in sequence. The time and the caller message are selectively displayed on the digital display means.

In the fourth aspect of the present invention, the time signal outputted by the time measuring means is inputted to the analog display means. The reception time is stored in the reception time storing means in response to a match signal of the call number comparing means. The received information signals stored are selected in response to an output signal of an external inputting means. The received signal outputted by the caller identifying signal storing means and the reception time signal outputted by the reception time storing means are selected by the pager display switching means. The signal outputted by the pager display switching means is inputted to the pager information analog display means. Further, the time signal outputted by the time measuring means and the received signal outputted by the message storing means are selected by the digital display switching means. The signal outputted by the digital display switching means is inputted to the digital display means. In summary, the time is displayed on the analog display means. The caller identification number and the reception time are displayed on the pager display means in sequence. The time and the caller message are selectively displayed on the digital display means.

In the electronic watch provided with a pager configured as described above, in usual, the time information outputted by the time measuring means is displayed on both the digital display means and the analog display means. Upon reception of an individual call signal, however, the output signal of the external inputting means is inputted to the display switching means. Then, the time information is switched to a caller identification number or a message signal such as a telephone number stored in the received information storing means. Therefore, it is possible to display the received pager by the analog display means and the digital display means.

The caller identifying signal is displayed by the analog display means, and the message such as continuous digits of a telephone number is displayed by the digital display means.

Further, in the electronic watch provided with a pager in which the output signal of the caller identifying signal storing means is inputted to the analog display means for pager information only, upon reception of the individual call signal, the caller identifying signal is displayed on the pager information display means different from the analog display means for displaying the time information of the time measuring means.

Further, in the electronic watch provided with a pager in which the reception time is stored in response to the match signal of the call number comparing means, whenever the call number matches the stored call number, the call reception time is stored. Further, when the stored reception time is selected by the external inputting means, the display switching means switches the caller identifying signal now displayed on the analog display means to the reception time display on the same display.

DETAILED DESCRIPTION OF THE PREFERRED EMBODIMENTS

Embodiments of the present invention will be described hereinbelow with reference to the attached drawings.

(1) FIRST EMBODIMENT

Figure 1:
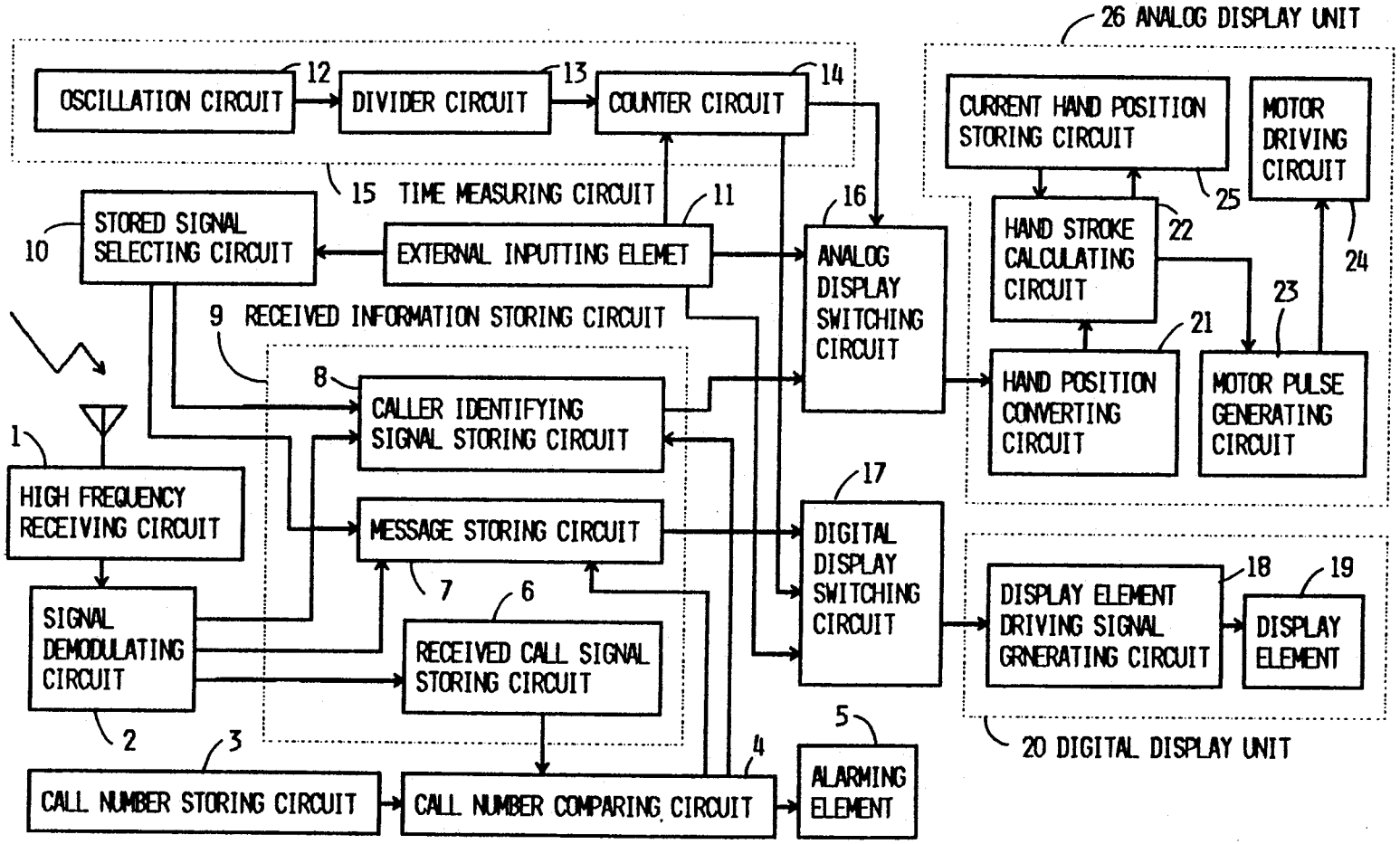
FIG. 1 is a system block diagram showing the first embodiment of the electronic watch provided with a pager according to the present invention.

FIG. 1 is a system block diagram showing a first embodiment of the electronic watch provided with a pager according to the present invention. In the drawing, a time measuring circuit 15 is composed of an oscillation circuit 12, a divider circuit 13 and a counter circuit 14. The output signal of the oscillation circuit 12 is divided into a specific frequency by the divider circuit 13. The output signal of the divider circuit 13 is inputted to the counter circuit 14 to count up time, so that the time measuring means can output time information.

An analog display unit 26 is composed of a hand position converting circuit 21 for inputting the output signal of an analog display switching circuit 16, a hand stroke calculating circuit 22 for calculating a hand stroke on the basis of the output signal of a current hand position storing circuit 25 and the output signal of the hand position converting circuit 21, a motor pulse generating circuit 23 for generating a motor driving signal on the basis of the output signal of the hand stroke calculating circuit 22, and a motor driving circuit 24 for driving a hand on the basis of the output signal of the motor pulse generating circuit 23.

A digital display unit 20 is composed of a display element driving signal generating circuit 18 for generating a display element driving signal on the basis of the output signal of a digital display switching circuit 17, and a display element 19 for displaying a signal in digital manner on the basis of the output signal of the display element driving signal generating circuit 18. Here the display element is an LCD (liquid crystal display) panel, an LED (light emitting diode) panel, etc.

Here, the case will be explained where the time information outputted by the time measuring circuit 15 is second in unit, and the hand for analog display is a second hand. The time information is converted into an absolute angular position of the second hand by the hand position converting circuit 21. If the time information is now 5 second and further the second hand rotates one revolution (360 degrees) through 60 steps, the absolute position of the second hand is given as "5." Here, the current absolute position of the second hand calculated by the hand stroke calculating circuit 22 and further stored in the current hand position storing means 25 is 4 second in this case. Therefore, a relative hand stroke of "1" can be obtained on the basis of the stored hand position "4" stored by the current hand position storing circuit 25 and the absolute position "5" converted by the hand position converting circuit 21.

Further, at this time, the information stored in the current hand position storing circuit 25 is updated to "5." Further, the output data "1" of the hand stroke calculating circuit 22 is inputted to the motor pulse generating circuit 23 to generate a motor pulse for driving the second hand by one step. Therefore, the second hand is driven by a motor via the motor driving circuit 24 by one step to the succeeding position of "5" second. The time information thus obtained can be displayed in analog manner as described above.

A high frequency receiving element 1 receives a pager information signal and then outputs the received signal to a signal demodulating circuit 2. The received pager information signal is demodulated by the signal demodulating circuit 2 into a digital signal, and then stored in a received information storing circuit 9. A call number comparing circuit 4 compares the received call signal now stored in the received information storing circuit 9 with call numbers previously stored in a call number storing circuit 3. When the received call signal matches any one of the stored call numbers, the call number comparing circuit 4 outputs a match signal to a message storing circuit 7 and a caller identifying signal storing circuit 8 for storing the message and the caller identifying signal. Further, the match signal is also outputted to an alarming element 5, so that the alarming element 5 informs the user of the call reception by sound, light, vibration, etc.

After the pager information has been received and further the received call number matches one of the stored call numbers, a signal is applied from an external inputting element 11 to the hand position converting circuit 21 via the analog display switching circuit 16, in order to switch the signal applied to the hand position converting circuit 21 from the output signal given by the time measuring circuit 15 to the output signal given by the caller identifying signal storing circuit 8. In the same way, the signal is applied from the external inputting element 11 to the display element drive signal generating circuit 18 via the digital display switching circuit 17, in order to switch the signal applied to the display element drive signal generating circuit 18 from the output signal given by the time measuring circuit 15 to the output signal given by the message storing circuit 7.

Figure 6:
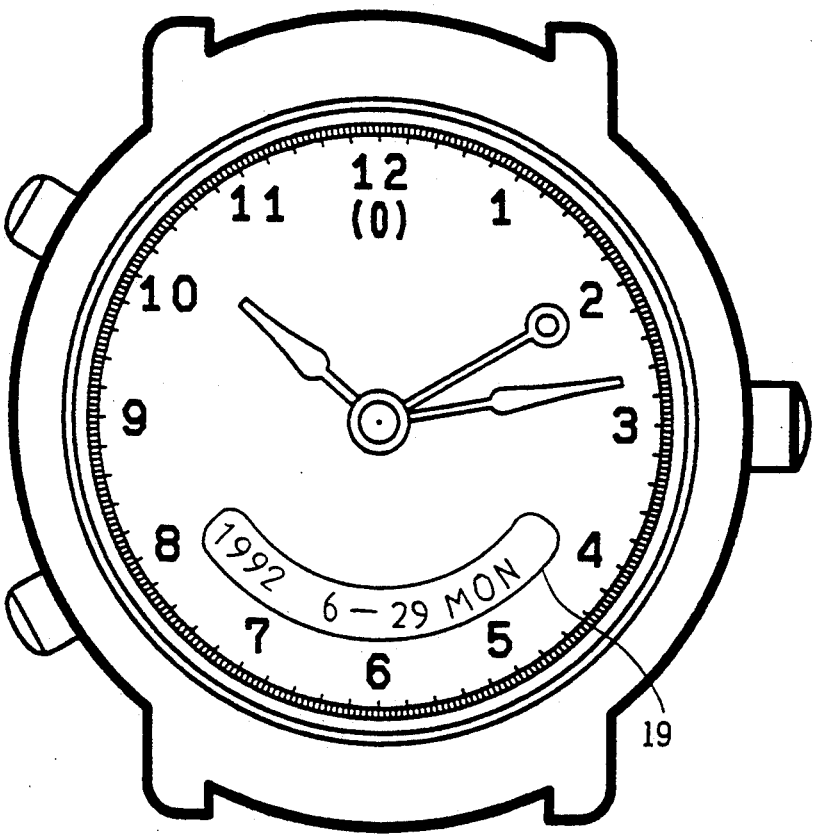
FIG. 6 is an external appearance view showing the first and third embodiments of the electronic watch provided with a pager according to the present invention.
Figure 7:
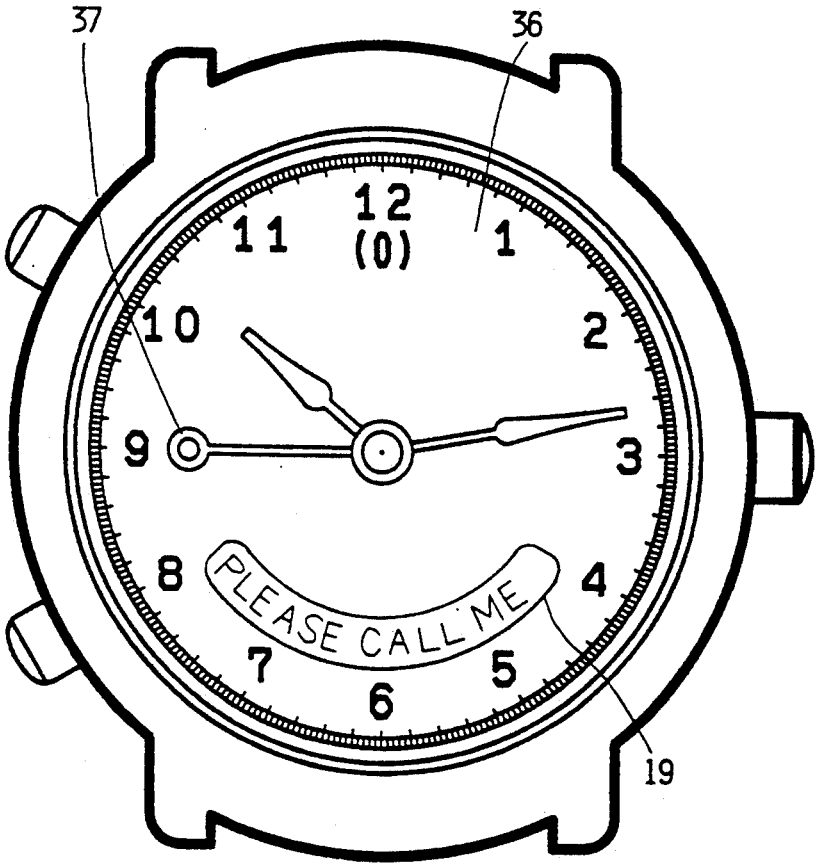
FIG. 7 is an external appearance view showing the first and third embodiments of the electronic watch provided with a pager according to the present invention.
Figure 8:
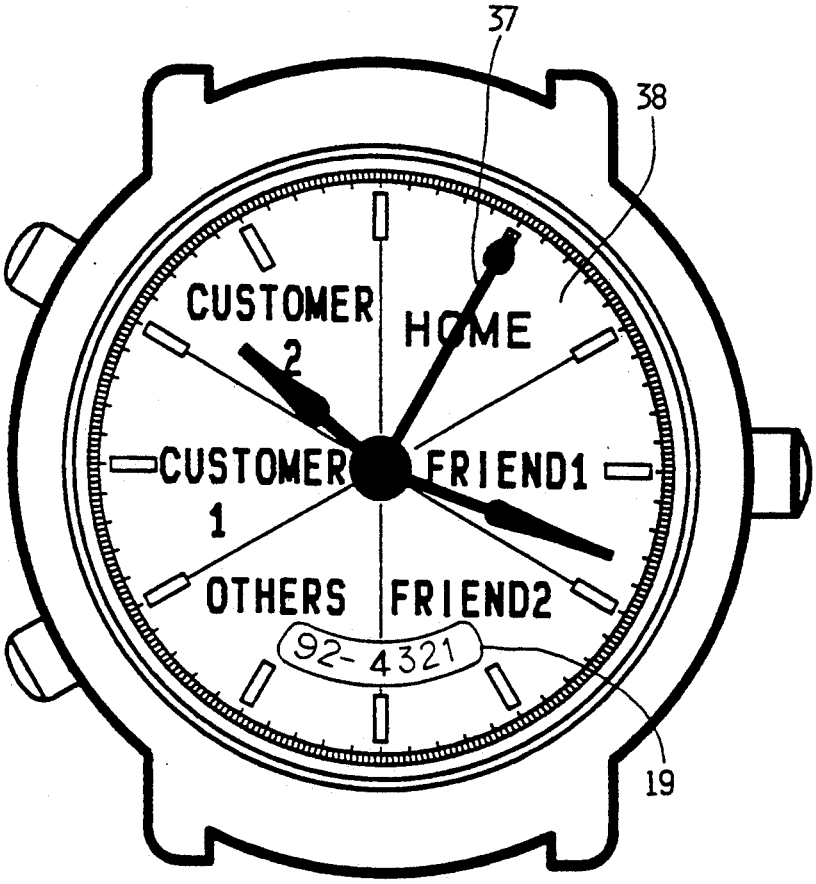
FIG. 8 is an external appearance view showing the first and third embodiments of the electronic watch provided with a pager according to the present invention.

FIGS. 6, 7 and 8 are external appearance views showing a first and third embodiments of the electronic watch provided with a pager according to the present invention.

In FIG. 6, in usual, the time information is displayed both by the display hands, and the display element 19. In FIG. 7, however, when pager information is received and the received call number matches one of the stored call numbers, a caller's message such as a telephone number is displayed by the digital display unit 20 including the display element 19. Further, the identification number of the caller is displayed by the analog display unit 26. That is, the user can identify the caller by seeing a digital mark on a digit dial 36 pointed by a second hand 37 (pager information indicating hand in this embodiment).

Further, as shown in FIG. 8, it is also possible to directly identify the caller, when characters or symbols for identifying callers are printed on an identify mark dial 38.

Further, in this embodiment, although the caller is pointed by the second hand, the hand for pointing the caller is not limited to only the second hand.

(2) SECOND EMBODIMENT

Figure 2:
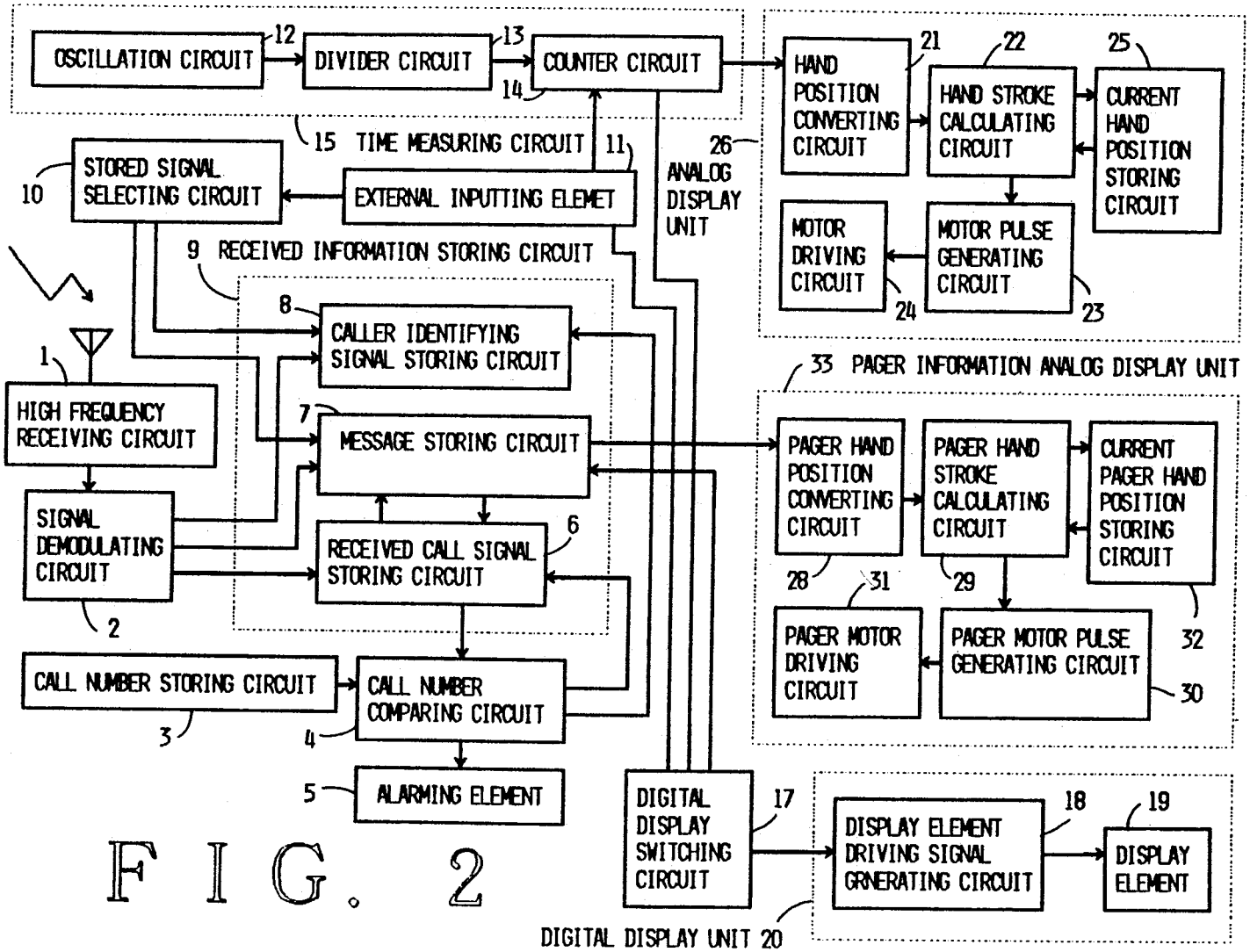
FIG. 2 is a system block diagram showing the second embodiment of the electronic watch provided with a pager according to the present invention.

FIG. 2 is a block diagram showing a second embodiment of the electronic watch provided with a pager according to the present invention.

In FIG. 2, the output of the time measuring circuit 15 is inputted to the analog display unit 26 and the digital display switching circuit 17, without using the analog display switching circuit 16 of the first embodiment shown in FIG. 1. Further, the output signal of the caller identifying signal storing circuit 8 is inputted to the pager information analog display unit 33.

Further, in this embodiment, the analog display unit 26 displays only the time information.

When the pager information is received and the received call number matches one of the stored call numbers, a signal is applied from the external inputting element 11 to the display element drive signal generating circuit 18 via the digital display switching circuit 17, in order to switch the signal applied to the display element drive signal generating circuit 18 from the output signal given by the time measuring circuit 15 to the output signal given by the message storing circuit 7.

On the other hand, the output signal of the caller identifying signal storing circuit 8 is inputted to the pager hand position converting circuit 28, and the caller identifying signal is displayed in analog manner by a pager information analog display unit 33 which is different from the analog display unit 26 for displaying the time information.

Figure 9:
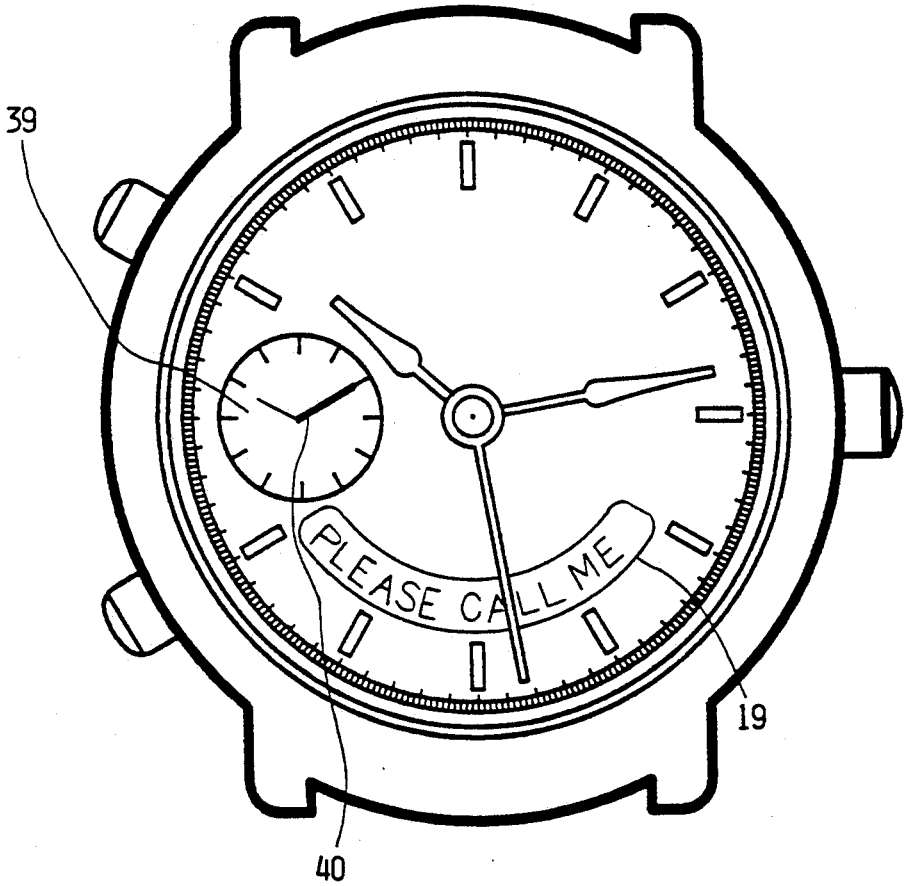
FIG. 9 is an external appearance view showing the second and fourth embodiments of the electronic watch provided with a pager according to the present invention.

FIG. 9 is an external appearance view showing the second and fourth embodiments of the electronic watch provided with a pager according to the present invention.

In FIG. 9, when pager information is received and the received call matches one of the stored call numbers, a caller's message such as a telephone number is displayed by the digital display unit 20 including the display element 19. Further, the identification number of the caller is displayed by the pager information analog display unit 33. That is, the user can identify the caller by seeing the mark on a sub-dial 39 pointed by a pager information hand 40.

(3) THIRD EMBODIMENT

Figure 3:
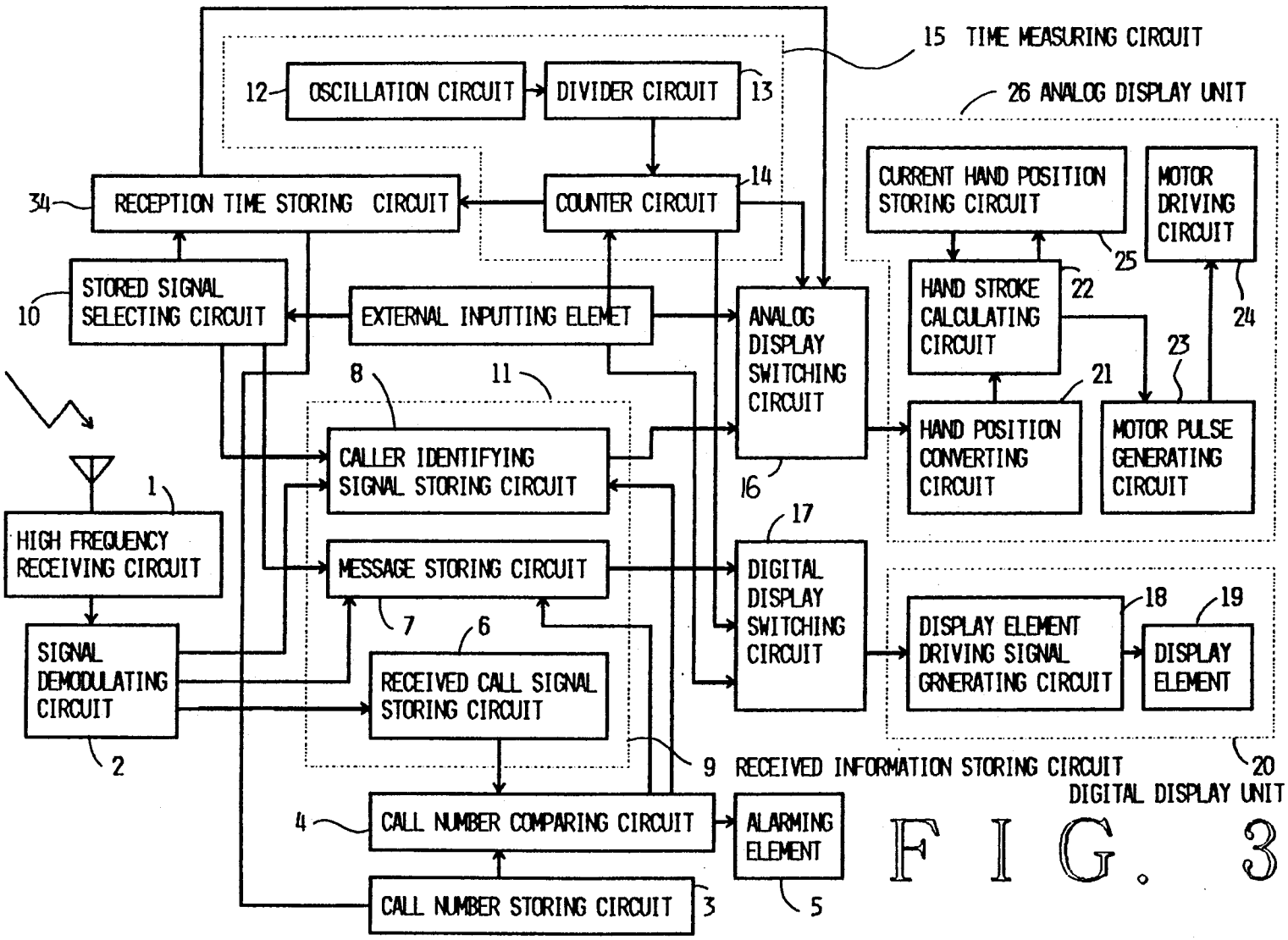
FIG. 3 is a system block diagram showing the third embodiment of the electronic watch provided with a pager according to the present invention.

FIG. 3 is a block diagram showing a third embodiment of the electronic watch provided with a pager according to the present invention.

In FIG. 3, a reception time storing circuit 34 for storing the reception time in response to the match signal of the call number comparing circuit 4 is additional provided for the first embodiment shown in FIG. 1.

When pager information is received and the received call number matches one of the stored call numbers, the call number comparing circuit 4 outputs the match signal to the message storing circuit 7 and the caller identifying signal storing circuit 8 to store the call identifying signal and the message such as a telephone number, together with the reception time.

A plurality of caller identifying signals and a plurality of reception time signals both stored in the past are inputted to the analog display switching circuit 16, respectively. A plurality of the message signals stored in the past are inputted to the digital display switching circuit 17. These past information data are selected in sequence by the external inputting element 11. In the analog display unit 26, the time signal display is switched to the caller identifying signal display, and further to the reception time signal display, in sequence. Further, in the digital display unit 20, the time signal display is switched to the message (e.g., a telephone number) display.

(4) FOURTH EMBODIMENT

Figure 4:
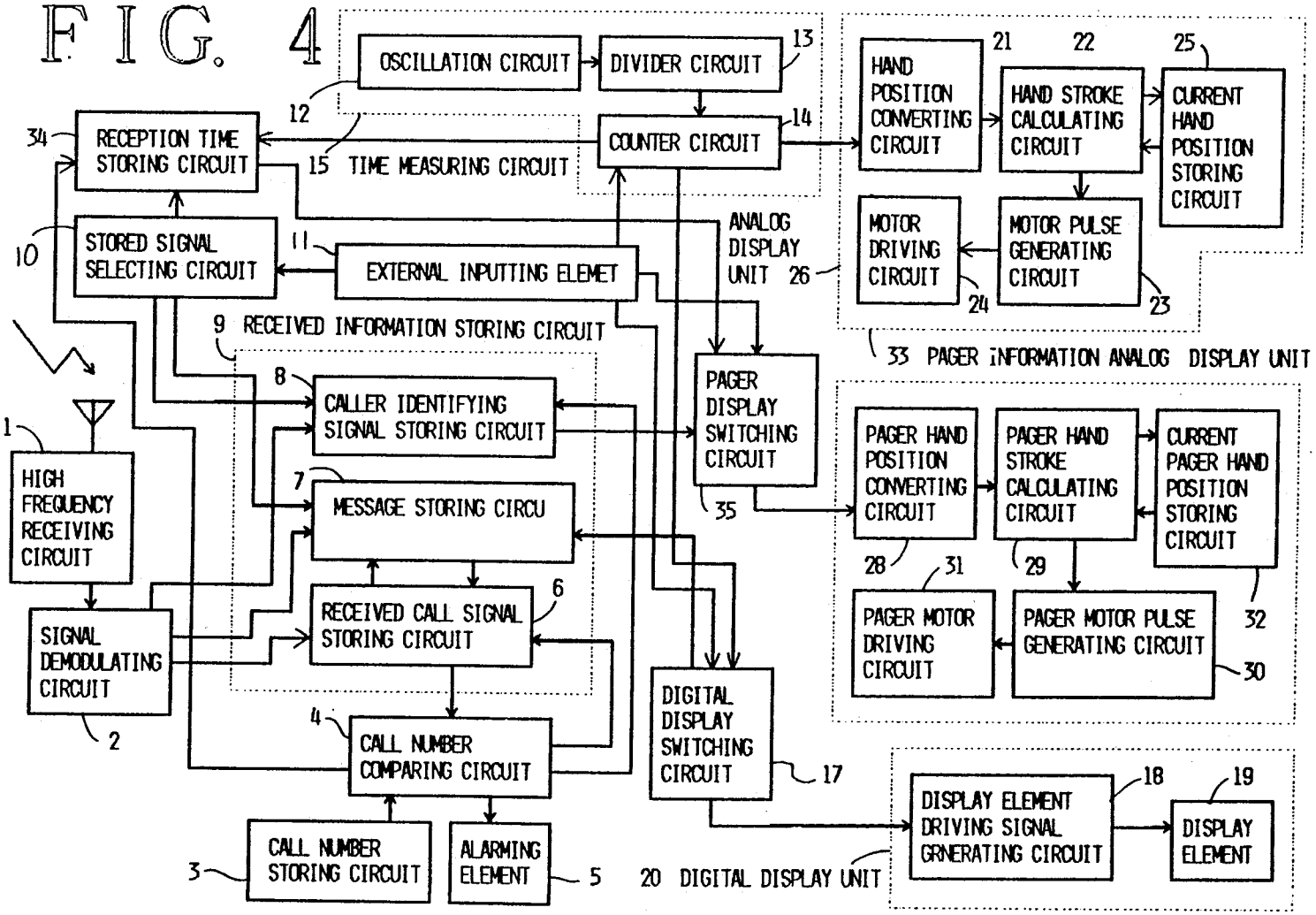
FIG. 4 is a system block diagram showing the fourth embodiment of the electronic watch provided with a pager according to the present invention.
Figure 5:
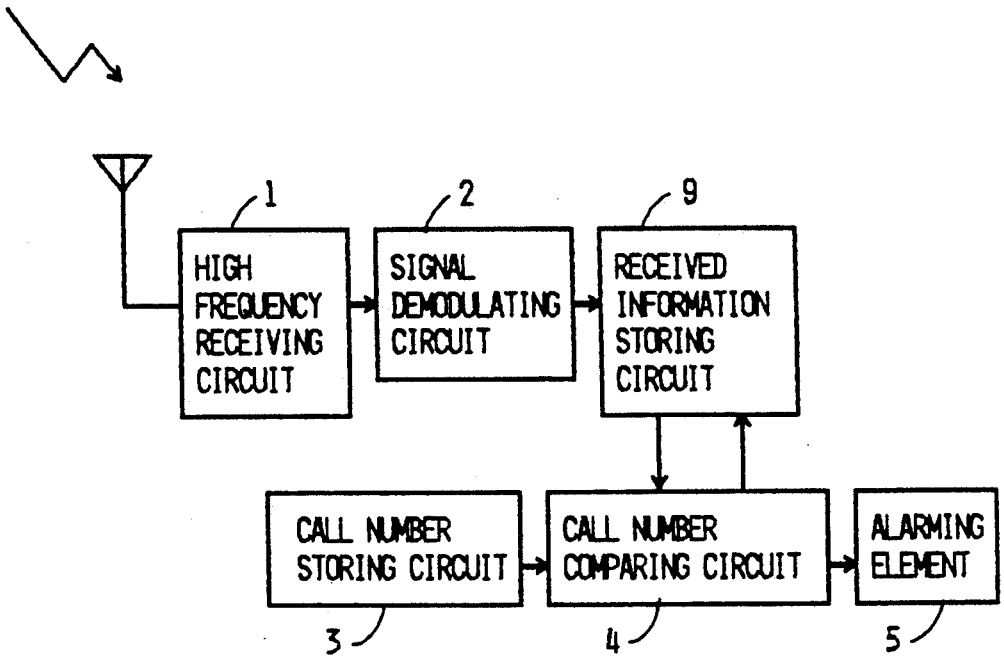
FIG. 5 PRIOR ART
FIG. 5 is a system block diagram showing a prior art pager.

FIG. 4 is a block diagram showing a fourth embodiment of the electronic watch provided with a pager according to the present invention.

In FIG. 4, the reception time storing circuit 34 for storing the reception time in response to the match signal of the call number comparing circuit 4 and the pager display switching circuit 35 are additional provided for the second embodiment shown in FIG. 2. Further, a reception time signal and the output signal of the caller identifying signal storing circuit 8 are inputted to the pager display switching circuit 35, and the output signal of the pager display switching circuit 35 is inputted the pager information analog display unit 33.

When pager information is received and the call number matches one of the stored call numbers, the call number comparing circuit 4 outputs the match signal to the message storing circuit 7 and the caller identifying signal storing circuit 8 to store the call identifying signal and the message such as a telephone number, together with the reception time.

A plurality of caller identifying signals and a plurality of reception time signals both stored in the past are inputted to the pager display switching circuit 35. A plurality of the message signals stored in the past are inputted to the digital display switching circuit 17. These past information data are selected in sequence by the external inputting element 11. In the pager information analog display unit 33, the caller identifying signal display is switched to the reception time signal display. Further, in the digital display unit 20, the time signal display is switched to the message (e.g., a telephone number) display.

As described above, in the present invention, in response to an output of the external inputting element, the display switching circuit selectively switches the time signal outputted by the time measuring circuit to the received information signal outputted by the received information storing circuit or vice versa. Further, the output signals of the display switching circuit are inputted both to the analog display unit and the digital display unit, respectively. Accordingly, there exists such an effect as to provide a combination watch excellent from the standpoints of design and fashion, which can display both the caller identification number and the message (e.g., a telephone number).

In addition, the same effect as above can be obtained by inputting the output signal of the received information storing circuit to the pager information analog display unit for displaying only the received information, without use of any display switching circuit.

What is claimed is:

1. An electronic watch provided with a pager comprising:

high frequency receiving means for receiving pager signals such as an individual call signal;

signal demodulating means for demodulating the received pager signals to digital signals;

received call signal storing means for storing the call signal;

message storing means for storing a callers' message signal such as a telephone number;

caller identifying signal storing means for storing a callers' identifying signal;

call number storing means for storing a plurality of previously given individual call number signals;

call number comparing means for comparing the received individual call signal with the previously given individual call number signals;

alarming means for generating an alarm when both compared results which compared by said call number comparing means match each other;

time measuring means for measuring time;

external inputting means for selecting information to be displayed;

stored signal selecting means responsive to an output signal of said external inputting means, for outputting the stored signals to said caller identifying signal storing means and said message storing means;

analog display switching means responsive to the output signal of said external inputting means, for switching an output signal of said time measuring means and an output signal of said caller identifying signal storing means;

hand position converting means for converting an output signal of said analog display switching means to hand position data for display;

current hand position storing means for storing current hand position data now displayed;

hand stroke calculating means for calculating a stroke of a hand to be displayed on the basis of an output signal of said hand position converting means and an output signal of said current hand position storing means;

motor pulse generating means for generating a motor driving pulse on the basis of an output signal of said hand stroke calculating means;

motor driving means for driving a motor on the basis of an output signal of said motor pulse generating means;

digital display switching means responsive of the output signal of said external inputting means, for switching the output signal of said time measuring means and an output signal of said message storing means;

display element signal generating means for generating a display element driving signal on the basis of an output signal of said digital display switching means; and a display element for displaying a digital display on the basis of an output signal of said display element driving signal generating means.

2. An electronic watch provided with a pager comprising:

high frequency receiving means for receiving pager signals such as an individual call signal;

signal demodulating means for demodulating the received pager signals to digital signals;

received call signal storing means for storing the call signal;

message storing means for storing a callers' message signal such as a telephone number;

caller identifying signal storing means for storing a callers' identifying signal;

call number storing means for storing a plurality of previously given individual call number signals;

call number comparing means for comparing the received individual call signal with the previously given individual call number signals;

alarming means for generating an alarm when both compared results which compared by said call number comparing means match each other;

time measuring means for measuring time;

external inputting means for selecting information to be displayed;

stored signal selecting means responsive to an output signal of said external inputting means, for outputting the stored signals to said caller identifying signal storing means and said message storing means;

hand position converting means for converting an output signal of said time measuring means to hand position data for display;

current hand position storing means for storing current hand position data now displayed;

hand stroke calculating means for calculating a stroke of a hand to be displayed on the basis of an output signal of said hand position converting means and an output signal of said current hand position storing means;

motor pulse generating means for generating a motor driving pulse on the basis of an output signal of said hand stroke calculating means;

motor driving means for driving a motor on the basis of an output signal of said motor pulse generating means;

pager hand position converting means for converting an output signal of said caller identifying signal storing means to pager hand position data for display;

current pager hand position storing means for storing current pager hand position data now displayed;

pager hand stroke calculating means for calculating a stroke of a pager hand to be displayed on the basis of an output signal of said pager hand position converting means and an output signal of said current pager hand position storing means;

pager motor pulse generating means for generating a pager motor driving pulse on the basis of an output signal of said pager hand stroke calculating means;

pager motor driving means for driving a pager motor on the basis of an output signal of said pager motor pulse forming means;

digital display switching means responsive to an output signal of said external inputting means, for switching the output signal of said time measuring means and an output signal of said message storing means of said received information storing means;

display element signal generating means for generating a display element driving signal on the basis of an output signal of said digital display switching means; and a display element for displaying a digital display on the basis of an output signal of said display element driving signal generating means.

3. An electronic watch provided with a pager comprising:

high frequency receiving means for receiving pager signals such as an individual call signal;

signal demodulating means for demodulating the received pager signals to digital signals;

received call signal storing means for storing the call signal, message storing means for storing a callers' message signal such as a telephone number;

caller identifying signal storing means for storing a callers' identifying signal;

call number storing means for storing a plurality of previously given individual call number signals;

call number comparing means for comparing the received individual call signal with the previously given individual call number signals;

alarming means for generating an alarm when both compared results which compared by said call number comparing means match each other;

time measuring means for measuring time;

external inputting means for selecting information to be displayed;

stored signal selecting means responsive to an output signal of said external inputting means, for selecting a stored signal thereof;

reception time storing means for storing a reception time on the basis of an output signal of said time measuring means, an output signal of said call number comparing means and an output signal of said storing means;

analog display switching means responsive to the output signal of said external inputting means, for switching an output signal of said time measuring means, an output signal of said reception time storing means, and an output signal of said caller identifying signal storing means;

hand position converting means for converting an output signal of said analog display switching means to hand position data for display;

current hand position storing means for storing current hand position data now displayed;

hand stroke calculating means for calculating a stroke of a hand to be displayed on the basis of an output signal of said hand position converting means and an output signal of said current hand position storing means;

motor pulse generating means for generating a motor driving pulse on the basis of an output signal of said hand stroke calculating means;

motor driving means for driving a motor on the basis of an output signal of said motor pulse generating means;

digital display switching means responsive to the output signal of said external inputting means, for switching the output signal of said time measuring means and an output signal of said message storing means of said received information storing means;

display element signal generating means for generating a display element driving signal on the basis of an output signal of said digital display switching means; and a display element for displaying a digital display on the basis of an output signal of said display element driving signal generating means.

4. An electronic watch provided with a pager comprising:

high frequency receiving means for receiving pager signals such as an individual call signal;

signal demodulating means for demodulating the received pager signals to digital signals;

received call signal storing means for storing the call signal;

message storing means for storing a callers' message signal such as a telephone number;

caller identifying signal storing means for storing a callers' identifying signal;

call number storing means for storing a plurality of previously given individual call number signals;

call number comparing means for comparing the received individual call signal with the previously given individual call number signals;

alarming means for generating an alarm when both compared results which compared by said call number comparing means match each other;

time measuring means for measuring time;

external inputting means for selecting information to be displayed;

stored signal selecting means responsive to an output signal of said external inputting means, for selecting a stored signal thereof;

reception time storing means for storing a reception time on the basis of an output signal of said time measuring means, an output signal of said call number comparing means and an output signal of said storing means;

pager display switching means responsive to an output signal of said external inputting means, for switching an output signal of said reception time storing means and an output signal of said caller identifying signal storing means;

hand position converting means for converting an output signal of said time measuring means to hand position data for display;

current hand position storing means for storing current hand position data now displayed;

hand stroke calculating means for calculating a stroke of a hand to be displayed on the basis of an output signal of said hand position converting means and an output signal of said current hand position storing means;

motor pulse generating means for generating a motor driving pulse on the basis of an output signal of said hand stroke calculating means;

motor driving means for driving a motor on the basis of an output signal of said motor pulse generating means;

pager hand position converting means for converting an output signal of said pager display switching means to pager hand position data for display;

current pager hand position storing means for storing current pager hand position data now displayed;

pager hand stroke calculating means for calculating a stroke of a pager hand to be displayed on the basis of an output signal of said pager hand position converting means and an output signal of said current pager hand position storing means;

pager motor pulse generating means for generating a pager motor driving pulse on the basis of an output signal of said pager hand stroke calculating means;

pager motor driving means for driving a pager motor on the basis of an output signal of said pager motor pulse forming means;

digital display switching means responsive to the output signal of said external inputting means, for switching the output signal of said time measuring means and an output signal of said message storing means;

display element signal generating means for generating a display element driving signal on the basis of an output signal of said digital display switching means; and a display element for displaying a digital display on the basis of an output signal of said display element driving signal generating means.

* * * * *